United States Patent [19]

Geenen et al.

[11] Patent Number: 4,818,224

[45] Date of Patent: Apr. 4, 1989

[54] PROCESS

[75] Inventors: Peter V. Geenen, The Hague; Jan Bennis, Amsterdam, both of Netherlands

[73] Assignee: Shell Oil Company, Houston, Tex.

[21] Appl. No.: 131,599

[22] Filed: Dec. 11, 1987

[51] Int. Cl.[4] ..... F27B 14/08

[52] U.S. Cl. ..... 432/248; 110/336; 264/30

[58] Field of Search ..... 432/3, 248; 110/336; 264/30

[56] References Cited

U.S. PATENT DOCUMENTS 3,836,613 9/1974 Granitzki et al. ..... 264/30

3,837,630 9/1974 Kuhl et al. ..... 264/30

4,174,331 11/1979 Myles ..... 264/30 X

*Primary Examiner*—Edward G. Favors

*Attorney, Agent, or Firm*—Albert J. Adamcik

[57] ABSTRACT

A process for reducing the cracking tendency and improving the strength of specified rammed plastic refractory reactor liners is described, the process comprising heating reactor liner mounted in a reactor, prior to its first use, to a temperature of from about 490° C. to about 510° C., the heating being carried out by heating said liner at a rate to produce a temperature increase of the liner not greater than about 6° C. per hour. A reactor comprising a vessel or tube having a liner of the type specified and cured in the manner described is also disclosed.

3 Claims, No Drawings

PROCESS

BACKGROUND OF THE INVENTION

Partial combustion or gasification of coal involves reacting the coal at elevated temperatures and possibly elevated pressures in specially designed reactors with a limited volume of oxygen, the reaction preferably being carried out in the presence of additional agents such as steam, carbon dioxide, or various other materials. The inner surfaces of the reactor vessel are commonly lined, at least at the beginning of a process run, with various refractory materials, which are held in place in various ways. Among the preferred reactor liner materials are those described as high temperature plastic ramming refractories.

These materials, however, suffer from a tendency to develop cracks and undergo dimensional changes (shrinkage), etc., during start-up. While applicants have no desire to be bound by any theory of invention, it is believed that the problem is caused by chemical decomposition or dehydration of binder materials of the liner, in addition to the loss of physically bound moisture. The invention addresses this problem, providing a novel method for curing such liners, and a new liner in accordance with such curing technique.

SUMMARY OF THE INVENTION

Accordingly, the invention, in one embodiment, comprises a process for reducing or minimizing the cracking tendency of a reactor liner composed of or comprising a refractory material selected from phosphate-bonded silicon carbide and phosphate-bonded alumina, comprising heating the reactor liner mounted in the reactor, prior to its first use, to a temperature of from about 490° C. to about 510° C., the heating being carried out by heating the reactor liner at a rate to produce a temperature increase not greater than about 6° C. per hour. In a preferred embodiment, the heating is continued to a temperature of about 800° C., the temperature being raised at a rate not greater than about 8° C. per hour.

In another embodiment, the invention comprises a reactor and liner of the type mentioned, cured by the process described.

DETAILED DESCRIPTION OF THE INVENTION

As indicated, the heating or curing technique of the invention is suitably employed with those plastic ramming liner refractories described as phosphate-bonded silicon carbide and phosphate-bonded alumina. These are high temperature refractories, suitably characterized as moldable or castable. Commercially available examples are Plibrico LC3001 (phosphate-bonded silicon carbide) and PLIRAM 94S (phosphate-bonded alumina), sold by Plibrico. In practice, the liner materials are "rammed" in place in the reactor vessel or tube, which may comprise suitable structure for holding the liner material on the reactor surface, and the liner may contain from about 1.5 percent to about 5 percent water, by weight.

According to the invention, the refractory liners are heated after placing in the reactor, prior to first use, from ambient temperature up to about 490° C. to about 510° C. The slow rate of heating or cure is believed to allow water to escape and certain chemical reactions to occur and prevents undue stress between the refractory and the reactor wall(s), which, as those skilled in the art will recognize, will most probably have different coefficients of expansion. As indicated, the temperature rise should not be greater than about 6° C. per hour, most preferably not greater than 5° C. per hour. In the preferred embodiment, the temperature is then raised from about 490° C. to 510° C. to about 800° C. at a rate not exceeding about 8° C. per hour.

The heating may be carried out in any suitable way, such as by hot gas or auxiliary heaters or burners in the reactor. Alternately, if the reactor comprises heat exchange tubes, the liner may suitably be cured by control of a heat exchange medium, such as steam, in the tubes.

DETAILED DESCRIPTION OF THE INVENTION

The following procedures were conducted.

Illustrative Embodiment I

Two samples or slabs of phosphate-bonded alumina were heated to a temperature of about 500° C., one according to the process of the invention, the other according to the heating procedure prescribed by the manufacturer (about 40° C. rise per hour). The sample treated according to the invention was heated at a rate of temperature rise not exceeding 4° C. per hour. A comparison of the samples showed that the sample treated according to the invention had smaller cracks and greater strength.

Illustrative Embodiment II

The procedures of the first illustrative embodiment are repeated, except that the samples were phosphate-bonded silicon carbide. Similar results are obtained.

What is claimed is:

1. A process for minimizing the cracking tendency and uncontrolled dimensional change, and improving the strength of, a rammed plastic refractory reactor liner comprising phosphate-bonded silicon carbide or phosphate-bonded alumina, comprising heating said reactor liner placed or mounted in a reactor, prior to its first use, from ambient temperature up to a temperature of from about 490° C. to about 510° C., the heating being carried out by heating said liner at a rate to produce a temperature increase of the liner not greater than about 6° C. per hour.

2. The process of claim 1 wherein, after the temperature of about 490° C. to 510° C. is reached, the heating is continued to produce a temperature of about 800° C., the temperature being raised at a rate of not greater than about 8° C. per hour.

3. A reactor comprising a vessel or tube having a rammed plastic liner, the liner comprising a cured refractory material selected from phosphate-bonded silicon carbide or phosphate bonded alumina produced by the process of claim 1.

* * * * *